US010355375B2

(12) United States Patent
Iwata et al.

(10) Patent No.: US 10,355,375 B2
(45) Date of Patent: Jul. 16, 2019

(54) TERMINAL-EQUIPPED ELECTRICAL WIRE

(71) Applicant: Yazaki Corporation, Tokyo (JP)

(72) Inventors: Masashi Iwata, Shizuoka (JP); Junya Shinohara, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/005,549

(22) Filed: Jun. 11, 2018

(65) Prior Publication Data

US 2019/0013595 A1 Jan. 10, 2019

(30) Foreign Application Priority Data

Jul. 4, 2017 (JP) ..... 2017-130892

(51) Int. Cl.

| | |
|---|---|
| ***H01R 4/18*** | (2006.01) |
| ***H01R 11/28*** | (2006.01) |
| *H01R 4/70* | (2006.01) |
| *H01R 43/00* | (2006.01) |
| *H01R 43/04* | (2006.01) |

(52) U.S. Cl.

CPC ..... *H01R 4/188* (2013.01); *H01R 4/183* (2013.01); *H01R 11/28* (2013.01); *H01R 4/70* (2013.01); *H01R 43/005* (2013.01); *H01R 43/04* (2013.01)

(58) Field of Classification Search

CPC ..... H01R 4/188; H01R 4/183; H01R 4/70; H01R 43/005; H01R 43/04; H01R 11/28

USPC ..... 439/865–869, 877, 741

See application file for complete search history.

(56) References Cited

U.S. PATENT DOCUMENTS

| | | | | | |
|---|---|---|---|---|---|
| 3,572,891 | A * | 3/1971 | Longenecker | G02B 6/403 | 29/517 |
| 3,622,954 | A * | 11/1971 | Hovnanian | H01R 11/12 | 439/857 |
| 4,371,229 | A * | 2/1983 | Spangler | H01R 4/206 | 439/865 |
| 5,338,233 | A * | 8/1994 | Endo | H01R 4/185 | 439/865 |
| 5,622,515 | A * | 4/1997 | Hotea | H01R 4/2454 | 29/884 |

FOREIGN PATENT DOCUMENTS

| | | |
|---|---|---|
| JP | 2017-84485 A | 5/2017 |
| JP | 2017-91919 A | 5/2017 |

* cited by examiner

*Primary Examiner* — Khiem M Nguyen

(74) *Attorney, Agent, or Firm* — Kenealy Vaidya LLP

(57) ABSTRACT

A terminal-equipped electrical wire includes a water-blocking material disposed between an inner side surface of an electrical wire connecting portion and a core wire to cover a distal end of the core wire, and the electrical wire connecting portion includes a bottom portion, a first crimping piece wrapped around the electrical wire, a second crimping piece wrapped around an outer side of the first crimping piece, and a plate-shaped protruding piece protruding from a side surface of the first crimping piece or the second crimping piece in an axial direction of the electrical wire, and the protruding piece is bent from a proximal end portion such that the protruding piece is closer to the distal end of the core wire toward a distal end side from a proximal end side of the protruding piece, and blocks at least a part of an opening of the electrical wire connecting portion.

1 Claim, 10 Drawing Sheets

TERMINAL-EQUIPPED ELECTRICAL WIRE

CROSS-REFERENCE TO RELATED APPLICATION(S)

The present application claims priority to and incorporates by reference the entire contents of Japanese Patent Application No. 2017-130892 filed in Japan on Jul. 4, 2017.

BACKGROUND OF THE INVENTION

1. Field of the Invention

The present invention relates to a terminal-equipped electrical wire.

2. Description of the Related Art

Conventionally, there is a crimp terminal which uses a water-blocking material. Japanese Patent Application Laid-open No. 2017-91919 discloses a technology regarding a crimp terminal including a protruding portion protruding toward a distal end side from an end portion on a distal end side on one end portion side of a conductor crimping portion. The protruding portion in Japanese Patent Application Laid-open No. 2017-91919 A is assumed to prevent occurrence of a position shift of a water-blocking material toward outside from the distal end side of the crimping portion.

Japanese Patent Application Laid-open No. 2017-84485 discloses a terminal having a protrusion formed at a part of a sealing portion. The protrusion in Japanese Patent Application Laid-open No. 2017-84485 is bent to partially block an opening portion at a distal end of the sealing portion. The protrusion prevents resin of the sealing portion from flowing outside at the time of compression.

There is still a room for improvement in terms of reliability of the terminal-equipped electrical wire. For example, the protrusion in Japanese Patent Application Laid-open No. 2017-84485 may reduce crimping performance of the crimp terminal, if the protrusion abuts against a bottom portion of the sealing portion at the time of crimping. The reliability of the terminal-equipped electrical wire is desirably increased while securing waterproof performance.

SUMMARY OF THE INVENTION

A purpose of the present invention is to provide a terminal-equipped electrical wire, the reliability of which is increased while securing waterproof performance.

According to an aspect of the present invention, a terminal-equipped electrical wire includes an electrical wire including a core wire and a cover covering the core wire, a distal end portion of the core wire being exposed from the cover; a terminal including an electrical wire connecting portion wrapped around the electrical wire to collectively cover the core wire and the cover; and a water-blocking material disposed between an inner side surface of the electrical wire connecting portion and the core wire to cover a distal end of the core wire. The electrical wire connecting portion includes a bottom portion, a first crimping piece joined to one end of the bottom portion in a width direction and wrapped around the electrical wire to collectively cover the core wire and the cover, a second crimping piece joined to another end of the bottom portion in the width direction and wrapped around an outer side of the first crimping piece, and a plate-shaped protruding piece protruding from a side surface of the first crimping piece or the second crimping piece in an axial direction of the electrical wire, and the protruding piece is bent from a proximal end portion such that the protruding piece is closer to the distal end of the core wire toward a distal end side from a proximal end side of the protruding piece, and blocks at least a part of an opening of the electrical wire connecting portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a terminal-equipped electrical wire according to an embodiment of the present invention will be described in detail with reference to the drawings. Additionally, the present invention is not limited to the embodiment. Moreover, structural elements in the following embodiment include elements that are easily conceivable by those skilled in the art or substantially identical elements.

EMBODIMENT

Figure 1:
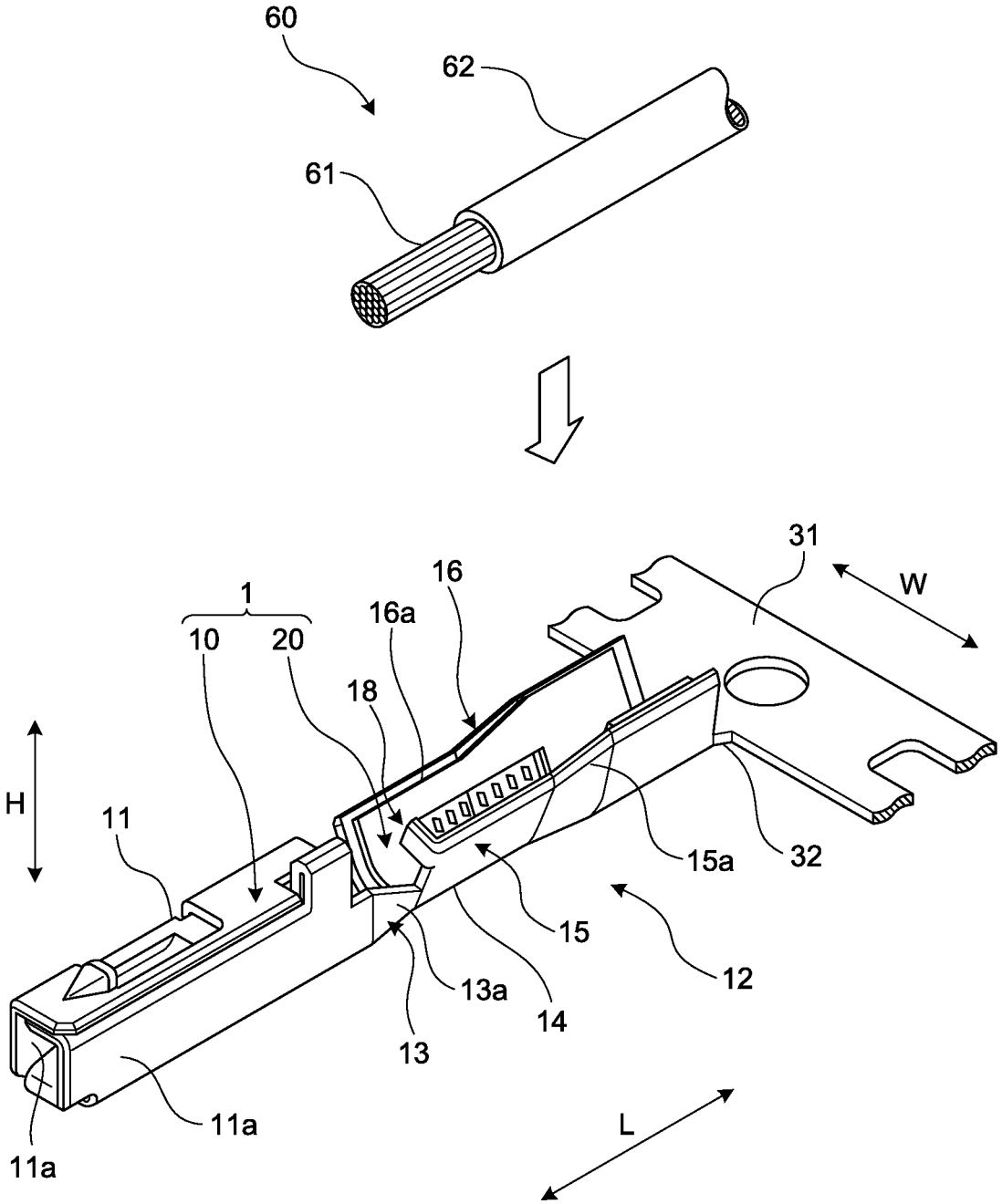
FIG. 1 is a perspective view illustrating a state before crimping of a crimp terminal according to an embodiment.
Figure 2:
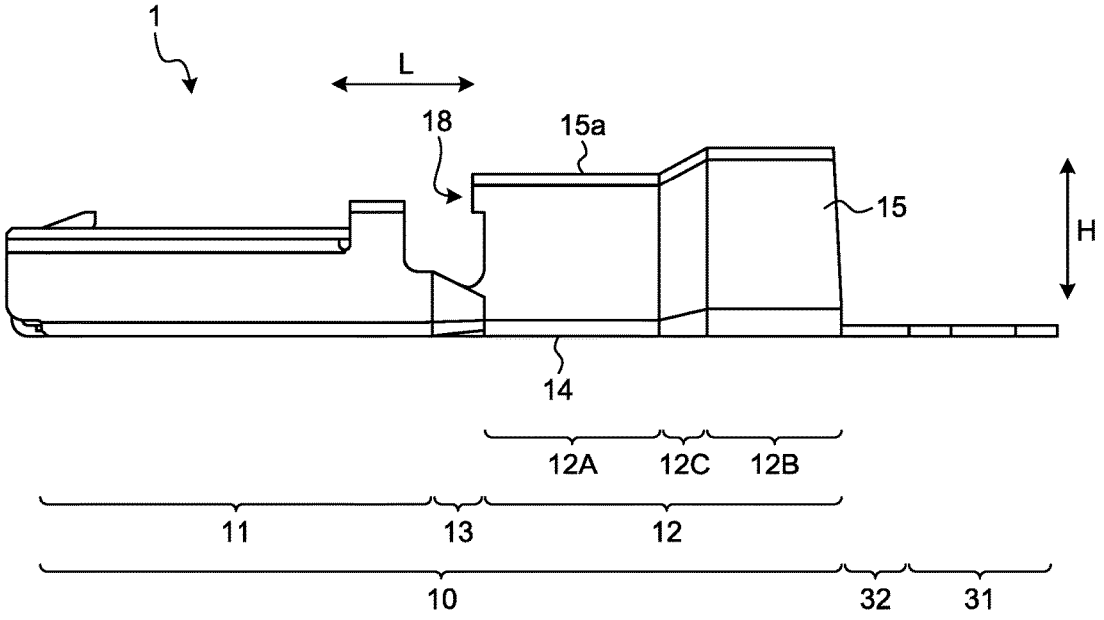
FIG. 2 is a side view illustrating the state before crimping of the crimp terminal according to the embodiment.
Figure 3:
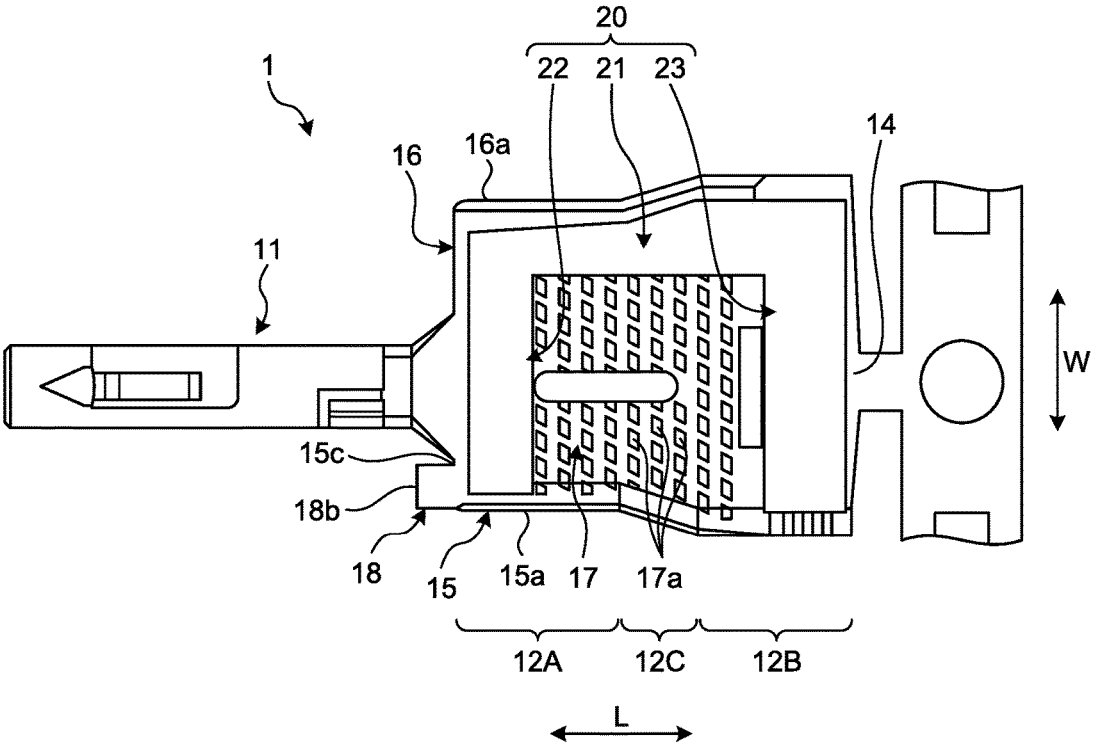
FIG. 3 is a plan view illustrating a state where a water-blocking material is attached to the crimp terminal according to the embodiment.
Figure 4:
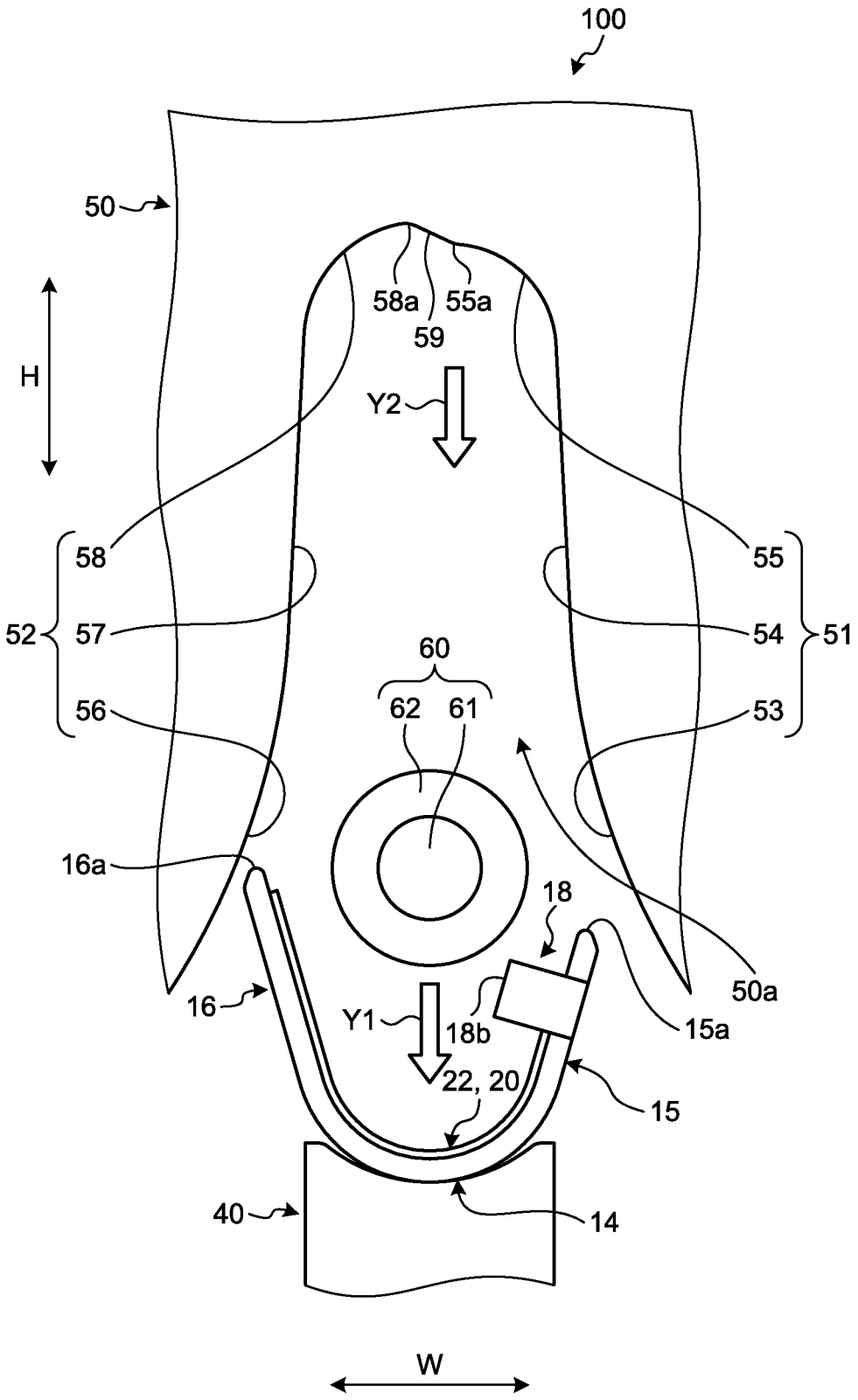
FIG. 4 is an explanatory diagram of a crimping step according to the embodiment.
Figure 5:
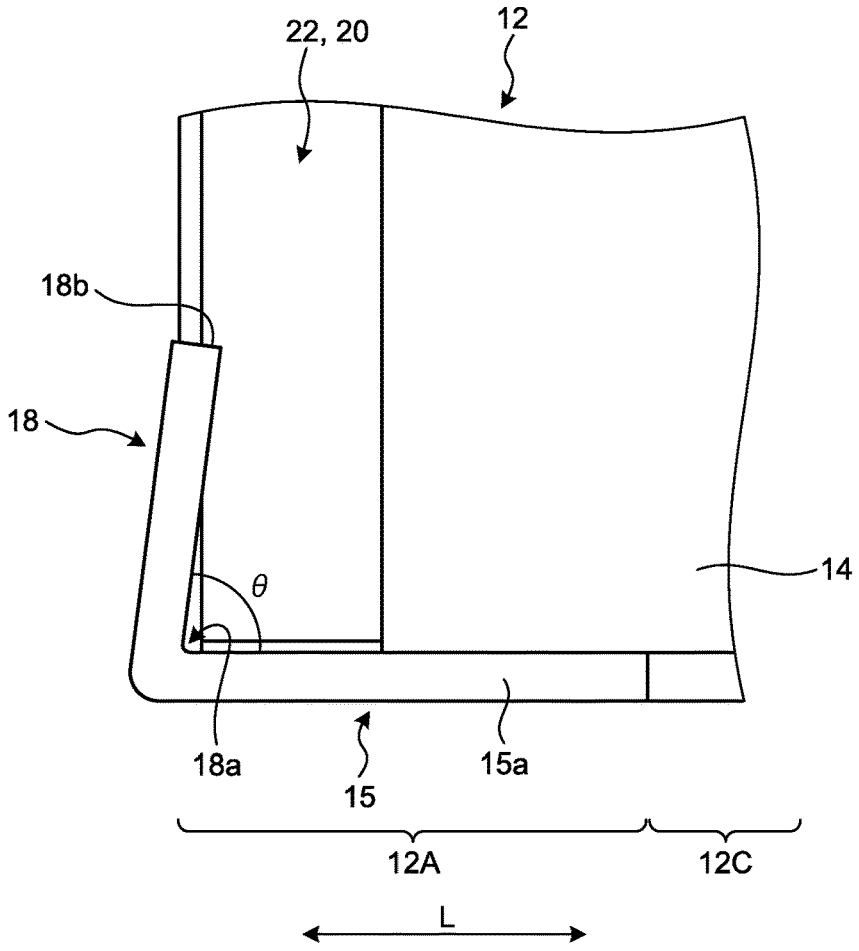
FIG. 5 is a diagram illustrating a protruding piece which is bent.
Figure 6:
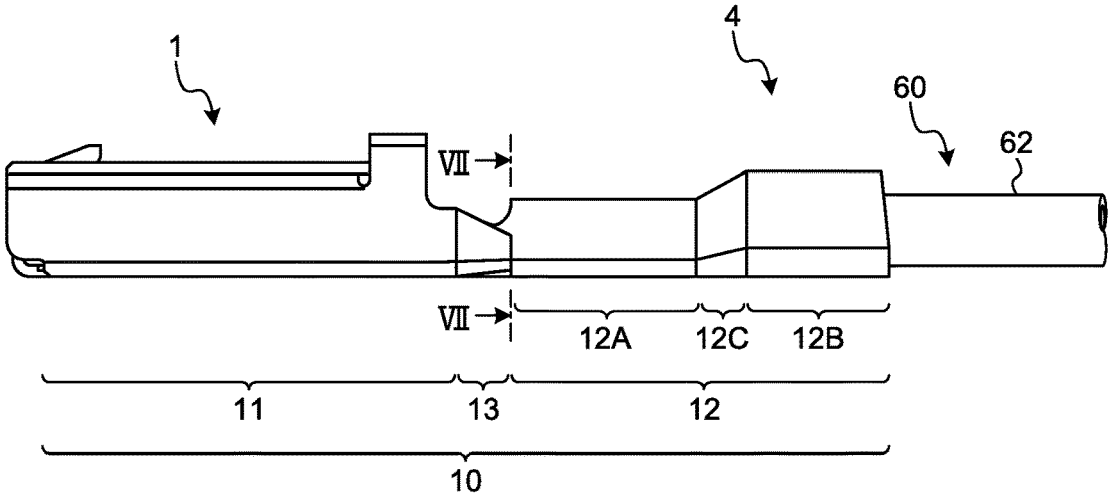
FIG. 6 is a side view of a terminal-equipped electrical wire according to the embodiment.
Figure 7:
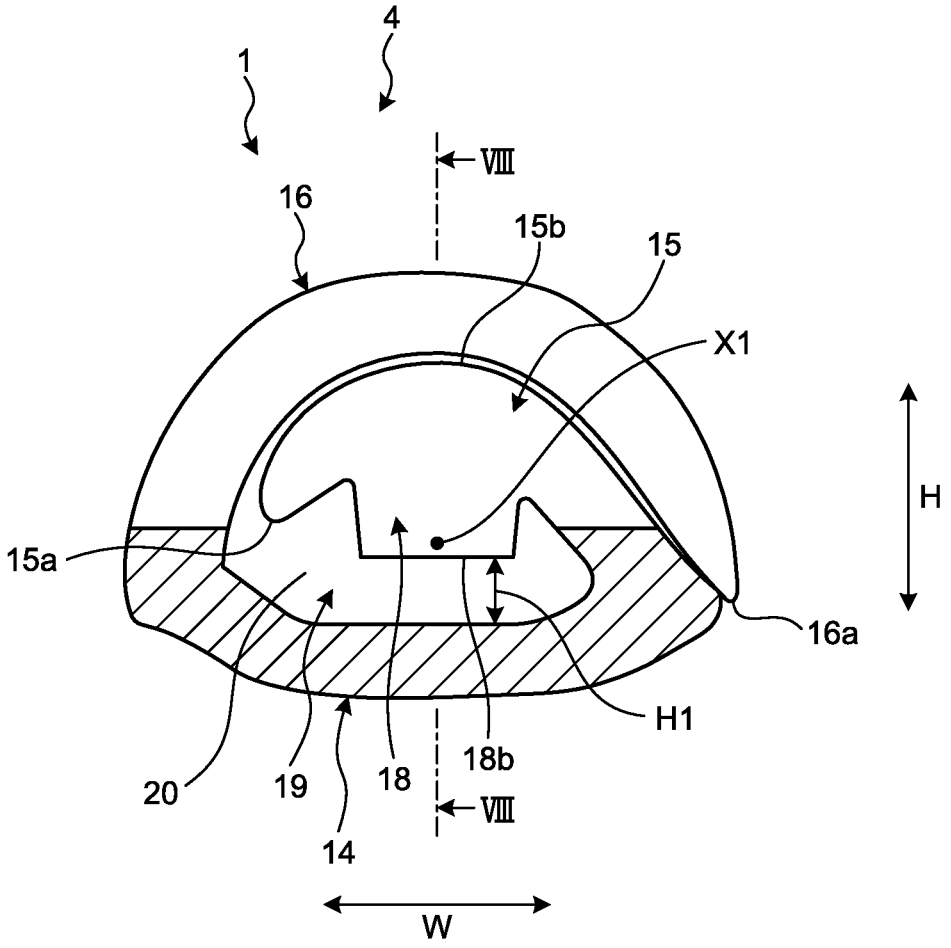
FIG. 7 is a cross-sectional view of the terminal-equipped electrical wire according to the embodiment.
Figure 8:
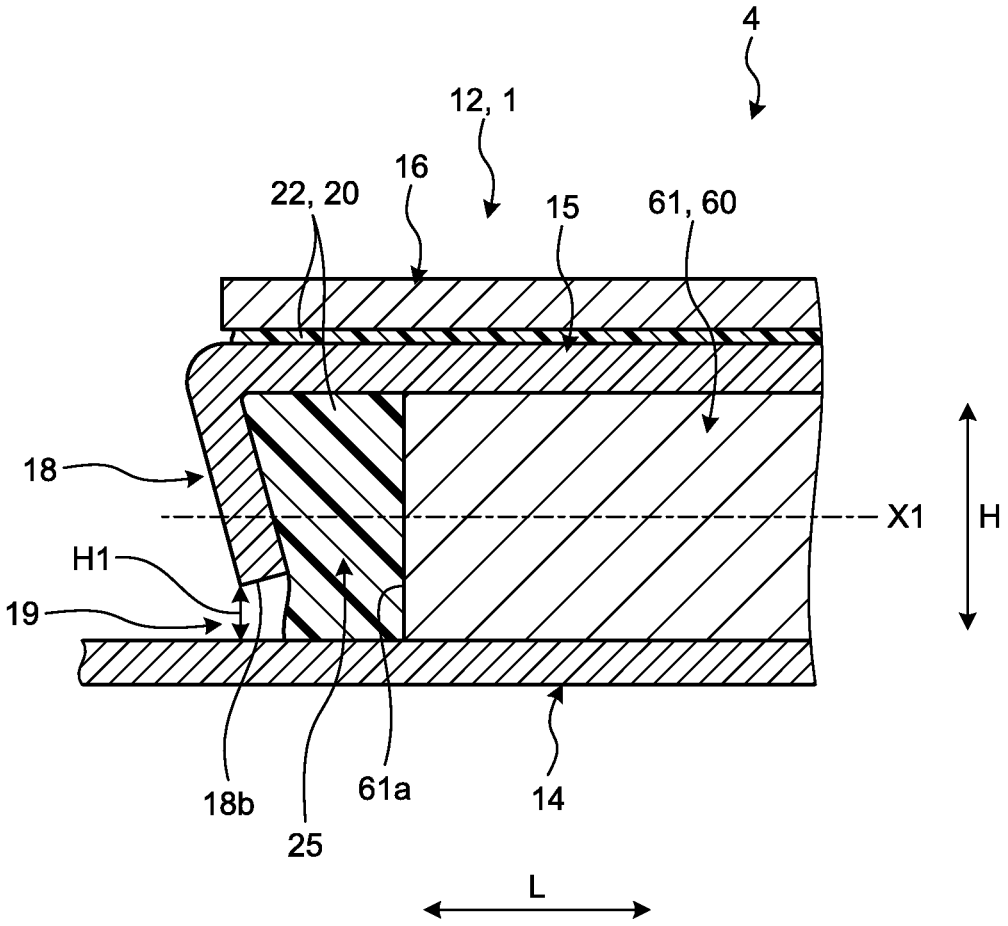
FIG. 8 is another cross-sectional view of the terminal-equipped electrical wire according to the embodiment.
Figure 9:
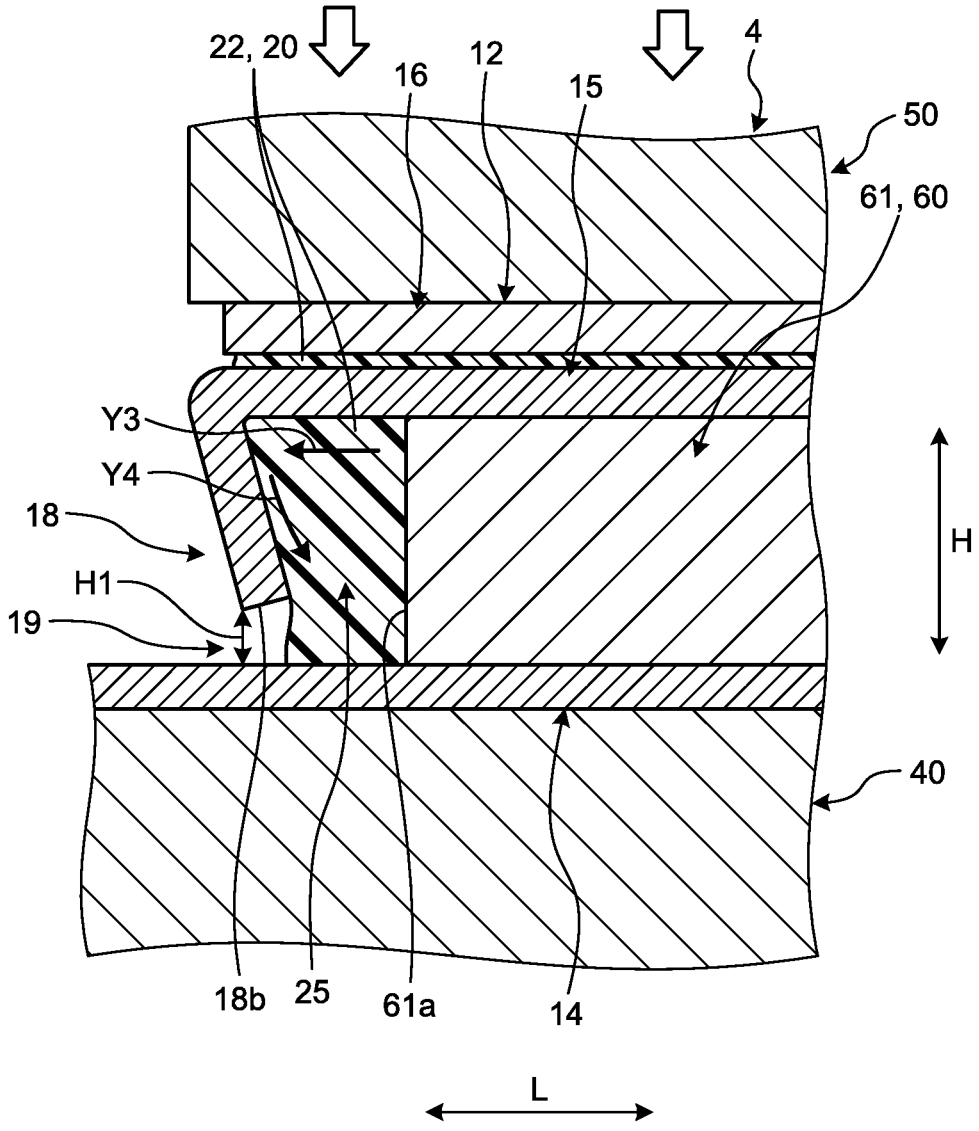
FIG. 9 is a cross-sectional view illustrating movement of the water-blocking material in the crimping step.
Figure 10:
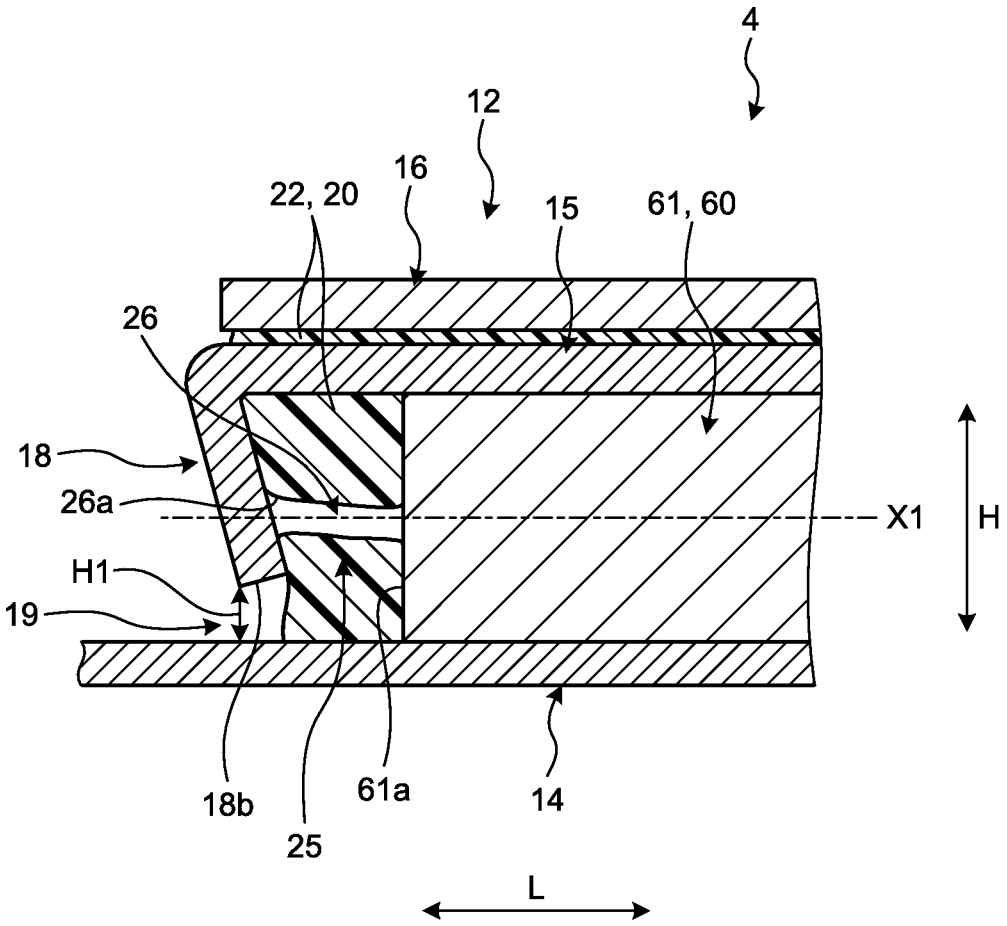
FIG. 10 is a cross-sectional view illustrating an air space created in the water-blocking material.

An embodiment will be described with reference to FIGS. 1 to 10. The present embodiment relates to a terminal-equipped electrical wire. FIG. 1 is a perspective view illustrating a state before crimping of a crimp terminal according to the embodiment, FIG. 2 is a side view illustrating the state before crimping of the crimp terminal according to the embodiment, FIG. 3 is a plan view illustrating a state where a water-blocking material is attached to the crimp terminal according to the embodiment, FIG. 4 is an explanatory diagram of a crimping step according to the embodiment, FIG. 5 is a diagram illustrating a protruding piece which is bent, FIG. 6 is a side view of a terminal-equipped electrical wire according to the embodiment, FIG. 7 is a cross-sectional view of the terminal-equipped electrical wire according to the embodiment, FIG. 8 is another cross-sectional view of the terminal-equipped electrical wire according to the embodiment, FIG. 9 is a cross-sectional view illustrating movement of the water-blocking material in the crimping step, and FIG. 10 is a cross-sectional view illustrating an air space created in the water-blocking material.

First, a crimp terminal 1 according to the present embodiment will be described. The crimp terminal 1 illustrated in FIG. 1 and the like is a terminal to be crimped to an electrical wire 60. The crimp terminal 1 is electrically connected, integrally with the electrical wire 60, to a counterpart terminal. A cover 62 on an end portion of the electrical wire 60 as a crimping target is removed, and a predetermined length of a core wire 61 is exposed. The core wire 61 may be a bundle of a plurality of wires, or may be a single wire such as a coaxial cable. The crimp terminal 1 is electrically connected to the exposed core wire 61 by being crimped to the end portion of the electrical wire 60.

The crimp terminal 1 includes a terminal fitting 10, and a water-blocking material 20. The terminal fitting 10 is a main part of the crimp terminal 1. The terminal fitting 10 is formed with a conductive metal plate (such as a copper plate, or a copper alloy plate) as a base material. The terminal fitting 10 is formed by punching, bending and the like of the base material, into a predetermined shape that can be connected to a counterpart terminal or the electrical wire 60. The terminal fitting 10 includes a terminal connecting portion 11, and an electrical wire connecting portion 12. The terminal connecting portion 11 is a part that is electrically connected to a counterpart terminal. The electrical wire connecting portion 12 is a part that is crimped to the electrical wire 60, and is electrically connected to the core wire 61.

A coupling portion 13 is provided between the terminal connecting portion 11 and the electrical wire connecting portion 12. In other words, the terminal connecting portion 11 and the electrical wire connecting portion 12 are coupled by the coupling portion 13. The coupling portion 13 includes side walls 13*a*, 13*a*. The side walls 13*a*, 13*a* join side walls 11*a*, 11*a* of the terminal connecting portion 11 to barrel piece portions 15, 16, which are side walls of the electrical wire connecting portion 12. One side wall 13*a* joins one side wall 11*a* and the first barrel piece portion 15, and the other side wall 13*a* joins the other side wall 11*a* and the second barrel piece portion 16. A height of the side walls 13*a* is lower than a height of the barrel piece portions 15, 16 and a height of the side walls 11*a*. The height of the side walls 13*a* is gradually reduced from the terminal connecting portion 11 toward the electrical wire connecting portion 12.

The terminal fitting 10 may be a male terminal or a female terminal. In the case where the terminal fitting 10 is a male terminal, the terminal connecting portion 11 is shaped into a male shape, and in the case where the terminal fitting 10 is a female terminal, the terminal connecting portion 11 is shaped into a female shape.

In the description of the crimp terminal 1, a direction of connecting to a counterpart terminal, or in other words, a direction of insertion to the counterpart terminal, will be referred to as a first direction L. The first direction L is a longitudinal direction of the crimp terminal 1. A width direction of the crimp terminal 1 will be referred to as a second direction W. The second direction W is a direction orthogonal to the first direction L. A direction, of the crimp terminal 1, orthogonal to both the first direction L and the second direction W will be referred to as a third direction H. The third direction H is a height direction of the crimp terminal 1. In the description of the crimp terminal 1, a side of the terminal connecting portion 11 in the first direction L will be referred to as "front side", and a side opposite the side of the terminal connecting portion 11 in the first direction L will be referred to as "rear side".

In a forming step, the crimp terminal 1 is formed into a flat plate shape, and from this state, the terminal connecting portion 11 is formed into a cylindrical shape, as illustrated in FIG. 1, in a terminal connecting portion forming step. In the terminal connecting portion forming step, bending and the like are performed on the terminal connecting portion 11. The terminal connecting portion 11 of the present embodiment is formed into a cylindrical shape having a rectangular cross section. The electrical wire connecting portion 12 is formed, in an electrical wire connecting portion forming step, to have a U-shaped cross section. In the electrical wire connecting portion forming step, bending and the like are performed on the electrical wire connecting portion 12. Moreover, in an attachment step, the water-blocking material 20 is attached to the electrical wire connecting portion 12. For example, the attachment step is performed prior to the electrical wire connecting portion forming step. Alternatively, the attachment step may be performed after the electrical wire connecting portion.

As illustrated in FIGS. 1 and 3, the electrical wire connecting portion 12 includes a bottom portion 14, the first barrel piece portion 15, the second barrel piece portion 16, and a protruding piece 18. The bottom portion 14 is a part which is a bottom wall of the U-shaped electrical wire connecting portion 12. At the time of crimping, the end portion of the electrical wire 60 is placed on the bottom portion 14. The first barrel piece portion 15 and the second barrel piece portion 16 are parts which are side walls of the U-shaped electrical wire connecting portion 12. The first barrel piece portion 15 and the second barrel piece portion 16 are joined to end portions of the bottom portion 14 in the second direction W. With the U-shaped electrical wire connecting portion 12, when the end portion of the electrical wire 60 is placed on the bottom portion 14, the first barrel piece portion 15 and the second barrel piece portion 16 enclose the electrical wire 60 from both sides in the second direction W.

Lengths of the first barrel piece portion 15 and the second barrel piece portion 16 from proximal ends on the side of the bottom portion 14 to end surfaces at distal ends 15*a*, 16*a* may be the same, or one length may be greater than the other. With the crimp terminal 1 of the present embodiment, the length of the second barrel piece portion 16 from the base to the distal end 16*a* is greater than the length of the first barrel piece portion 15 from the base to the distal end 15*a*. For example, the first barrel piece portion 15 and the second barrel piece portion 16 are wrapped around the electrical wire 60 while overlapping each other.

The end portion of the electrical wire 60 is inserted from a U-shaped opening portion of the electrical wire connecting portion 12, or in other words, a gap between the distal ends 15*a*, 16*a*, into a space inside the U-shape. The electrical wire connecting portion 12 is shaped such that the end portion of the electrical wire 60 is easily inserted. Specifically, with the electrical wire connecting portion 12, a gap between the first barrel piece portion 15 and the second barrel piece portion 16 in the second direction W is increased from the bottom portion 14 side toward the distal ends 15*a*, 16*a*.

As illustrated in FIGS. 2 and 3, the first barrel piece portion 15 and the second barrel piece portion 16 include a core wire crimping portion 12A, a cover crimping portion 12B, and a coupling crimping portion 12C. The coupling crimping portion 12C is present between the core wire crimping portion 12A and the cover crimping portion 12B. The first barrel piece portion 15 and the second barrel piece portion 16 are each a piece portion where the crimping portions 12A, 12C, 12B are continuous in this order along the first direction L.

The core wire crimping portion 12A is a part that is crimped to the core wire 61 at a distal end of the electrical wire 60. The core wire crimping portion 12A is a part, of each barrel piece portion 15, 16, closest to the coupling portion 13. In other words, the core wire crimping portion 12A is positioned at a most front side, of each barrel piece portion 15, 16, in the direction of insertion to a counterpart terminal. The cover crimping portion 12B is a part that is crimped to an end portion of the cover 62. The cover crimping portion 12B is a part, of each barrel piece portion 15, 16, that is positioned farthest from the coupling portion 13. That is, the cover crimping portion 12B is positioned at a most rear side, of each barrel piece portion 15, 16, in the direction of insertion to a counterpart terminal. The coupling crimping portion 12C is a part that joins the core wire crimping portion 12A and the cover crimping portion 12B. The coupling crimping portion 12C is crimped to a boundary portion of the core wire 61 and the cover 62 of the electrical wire 60.

As illustrated in FIG. 3, a serration region 17 is provided on an inner side surface of the electrical wire connecting portion 12, or in other words, a wall surface for covering the electrical wire 60. The serration region 17 is a core wire holding region for holding the core wire 61. The serration region 17 is a region, on the inner side surface of the electrical wire connecting portion 12, including a part that is to be wrapped around the core wire 61. In the serration region 17, a plurality of recessed portions, a plurality of protruding portions, or a combination of recessed portions and protruding portions are arranged. The recessed portions and the protruding portions increase a contact area between the electrical wire connecting portion 12 and the core wire 61, and increase an adhering strength between the two. The serration region 17 of the present embodiment is a rectangular region. A plurality of recessed portions 17*a* are formed in the serration region 17. The recessed portions 17*a* are aligned along the first direction L and the second direction W.

As illustrated in FIG. 3, the protruding piece 18 of the present embodiment protrudes from a side surface 15*c* of the first barrel piece portion 15. The protruding piece 18 is integrated with the first barrel piece portion 15, and is formed by stamping of a base material. The side surface 15*c* is a side surface of the first barrel piece portion 15 facing along the first direction L. More specifically, the side surface 15*c* is a side surface facing the terminal connecting portion 11 side, or in other words, a side surface on a front end of the first barrel piece portion 15. The protruding piece 18 is provided at an end portion of the first barrel piece portion 15 in the second direction W. The protruding piece 18 is a plate-shaped piece portion. In plan view, the protruding piece 18 of the present embodiment is rectangular.

Now, ingress of water between the core wire 61 and the electrical wire connecting portion 12 crimped to the core wire 61 is not desirable. For example, in the case where ionization tendency is different between a metal material of the core wire 61 and a metal material of the electrical wire connecting portion 12, corrosion is possibly caused. For example, in the case where the material of the core wire 61 is aluminum and the material of the electrical wire connecting portion 12 is copper, the core wire 61 is possibly corroded. The crimp terminal 1 of the present embodiment is provided with the water-blocking material 20. The water-blocking material 20 prevents ingress of water between the electrical wire connecting portion 12 and the core wire 61.

For example, the water-blocking material 20 is a sheet-shaped member which is mainly an adhesive such as an acrylic adhesive. As the water-blocking material 20 of the present embodiment, an adhesive sheet which is made by soaking a non-woven sheet fabric in an adhesive and which has an adhesive effect on both surfaces is used.

For example, as illustrated in FIG. 3, the water-blocking material 20 is attached to the inner side surface of the flat plate-shaped electrical wire connecting portion 12. As illustrated in FIG. 3, the water-blocking material 20 is formed into a predetermined shape, and includes a first water-blocking portion 21, a second water-blocking portion 22, and a third water-blocking portion 23. After crimping is completed, the first water-blocking portion 21 blocks water at a part where the first barrel piece portion 15 and the second barrel piece portion 16 overlap each other. That is, the first water-blocking portion 21 is sandwiched between the first barrel piece portion 15 and the second barrel piece portion 16 overlapping each other, and forms a water-blocking region between the barrel piece portions 15, 16. The first water-blocking portion 21 of the present embodiment is disposed on the second barrel piece portion 16, and extends along the first direction L.

The second water-blocking portion 22 blocks water on the terminal connecting portion 11 side than a distal end of the core wire 61. The second water-blocking portion 22 is disposed at an end portion of the electrical wire connecting portion 12, on the terminal connecting portion 11 side, and extends along the second direction W. At least a part of the second water-blocking portion 22 is desirably provided in a region where the core wire 61 is placed. For example, the second water-blocking portion 22 is sandwiched between the barrel piece portions 15, 16 overlapping each other, and forms a water-blocking region in a gap between the barrel piece portions 15, 16. Furthermore, the second water-blocking portion 22 may also come into contact and closely adhere to itself in a crimping step to thereby block a gap on the terminal connecting portion 11 side than the distal end of the core wire 61. The second water-blocking portion 22 prevents ingress of water from the terminal connecting portion 11 side into between the electrical wire connecting portion 12 and the core wire 61.

The third water-blocking portion 23 prevents ingress of water from a gap between the electrical wire connecting portion 12 and the cover 62. The third water-blocking portion 23 is disposed at an end portion of the electrical wire connecting portion 12, on a side opposite the terminal connecting portion 11 side, or in other words, at a proximal end portion of the electrical wire connecting portion 12, and extends along the second direction W. The third water-blocking portion 23 is sandwiched between the cover 62 and the electrical wire connecting portion 12, and forms a water-blocking region between the cover 62 and the electrical wire connecting portion 12.

The terminal fitting 10 described above is processed through the stamping step of one metal plate as a base material and the terminal connecting portion forming step, into a form including the flat plate-shaped electrical wire connecting portion 12 as illustrated in FIG. 3. In the following water-blocking material attachment step, the water-blocking material 20 is attached to the flat plate-shaped electrical wire connecting portion 12. Then, in the electrical wire connecting portion forming step, the electrical wire connecting portion 12 is formed into a U-shape.

The electrical wire connecting portion 12 is crimped to the electrical wire 60 by an anvil 40 and a crimper 50 illustrated in FIG. 4. The anvil 40 and the crimper 50 are structural elements of a terminal crimping device 100. The anvil 40 is a mold on a support side for supporting the electrical wire connecting portion 12 from below. The anvil 40 supports an outer side surface of the bottom portion 14 of the electrical wire connecting portion 12. Accordingly, the first barrel piece portion 15 and the second barrel piece portion 16 extend obliquely upward from the bottom portion 14 in a state where the electrical wire connecting portion 12 is supported by the anvil 40.

The crimper 50 is a terminal crimping mold for crimping the electrical wire connecting portion 12 to the electrical wire 60 while sandwiching the electrical wire connecting portion 12 and the electrical wire 60 with the anvil 40. The crimper 50 is disposed above the anvil 40. The crimper 50 moves relative to the anvil 40 in the third direction H. The terminal crimping device 100 includes a drive device for vertically moving the crimper 50 in the third direction H.

The crimper 50 includes a recessed swage portion 50*a* which is recessed on an opposite side from the anvil 40. The swage portion 50*a* is a groove-shaped recessed portion provided on a lower surface of the crimper 50. The swage portion 50*a* includes a first wall surface 51, and a second wall surface 52. The first wall surface 51 is a wall surface for guiding the first barrel piece portion 15. The second wall surface 52 is a wall surface for guiding the second barrel piece portion 16. The first wall surface 51 and the second wall surface 52 extend along the third direction H.

The first wall surface 51 includes a first fringe portion 53, a first intermediate portion 54, and a first arc portion 55. The second wall surface 52 includes a second fringe portion 56, a second intermediate portion 57, and a second arc portion 58. The first fringe portion 53 is a part, of the first wall surface 51, closest to an opening side, or in other words, a lowest part in the third direction H. The first arc portion 55 is a deepest part of the first wall surface 51, or in other words, a highest part in the third direction H. The first intermediate portion 54 is a part between the first fringe portion 53 and the first arc portion 55. The second fringe portion 56 is a part, of the second wall surface 52, closest to the opening side. The second arc portion 58 is a deepest part of the second wall surface 52. The second intermediate portion 57 is a part between the second fringe portion 56 and the second arc portion 58.

The first fringe portion 53 and the second fringe portion 56 face each other in the second direction W. The first fringe portion 53 and the second fringe portion 56 are more curved away from each other on the opening side. When the crimper 50 is lowered toward the anvil 40, the first fringe portion 53 contacts the distal end 15*a* of the first barrel piece portion 15, and the second fringe portion 56 contacts the distal end 16*a* of the second barrel piece portion 16. The first fringe portion 53 presses the first barrel piece portion 15 toward the second barrel piece portion 16. The second fringe portion 56 presses the second barrel piece portion 16 toward the first barrel piece portion 15. The gap between the first barrel piece portion 15 and the second barrel piece portion 16 is narrowed by pressure from the first fringe portion 53 and the second fringe portion 56.

The first intermediate portion 54 and the second intermediate portion 57 face each other in the second direction W. The first intermediate portion 54 and the second intermediate portion 57 are each a flat surface. The first intermediate portion 54 and the second intermediate portion 57 are more tilted toward each other on the deeper side. Tilt angles of the first intermediate portion 54 and the second intermediate portion 57 with respect to the third direction H are small. The first intermediate portion 54 and the second intermediate portion 57 press and support the cover crimping portions 12B from both sides in the second direction W in such a way that the first barrel piece portion 15 and the second barrel piece portion 16 become substantially parallel to each other.

The first arc portion 55 and the second arc portion 58 face each other in the second direction W. The first arc portion 55 and the second arc portion 58 are recessed curved surfaces which are curved when seen in the first direction L. The first arc portion 55 and the second arc portion 58 are more curved toward each other on a deeper side of the swage portion 50*a*. An end portion 55*a* of the first arc portion 55 is positioned closer to the opening side of the swage portion 50*a* than an end portion 58*a* of the second arc portion 58. In other words, the end portion 58*a* of the second arc portion 58 is positioned on an upper side than the end portion 55*a* of the first arc portion 55. Because the positions of the end portions 55*a*, 58*a* are different in the above manner, the first barrel piece portion 15 gets inside the second barrel piece portion 16 at the time of crimping.

The first arc portion 55 and the second arc portion 58 are joined by a tilted surface 59. The tilted surface 59 is provided from the end portion 55*a* of the first arc portion 55 to the end portion 58*a* of the second arc portion 58. The tilted surface 59 is more tilted toward the deeper side of the swage portion 50*a* on the second arc portion 58 side than on the first arc portion 55 side.

In the crimping step, the electrical wire connecting portion 12 is crimped to the electrical wire 60. In the crimping step, the bottom portion 14 of the electrical wire connecting portion 12 is placed on an upper surface of the anvil 40, as illustrated in FIG. 4. The electrical wire 60 is placed on an inner side surface of the bottom portion 14 (arrow Y1). The protruding piece 18 of the electrical wire connecting portion 12 placed on the anvil 40 is bent. More specifically, as illustrated in FIG. 5, the protruding piece 18 is bent along a boundary line 18*a* to the second barrel piece portion 16, toward the first barrel piece portion 15. Bending of the protruding piece 18 is performed in a bending step, for example. As illustrated in FIG. 5, the protruding piece 18 is bent in such a way that an angle θ to an inner side surface of the first barrel piece portion 15 is made an acute angle. In other words, the protruding piece 18 is tilted in such a way that the protruding piece 18 is closer to the coupling crimping portion 12C on a distal end 18*b* side of the protruding piece 18 than on the proximal end side.

At the time of crimping the electrical wire connecting portion 12 to the electrical wire 60, the terminal crimping device 100 lowers the crimper 50 toward the anvil 40, as indicated by an arrow Y2. The swage portion 50*a* of the crimper 50 contacts the first barrel piece portion 15 and the second barrel piece portion 16, and presses the barrel piece portions 15, 16 from both sides in the second direction W. The swage portion 50*a* moves lower while sliding against the barrel piece portions 15, 16, and narrows the gap between the barrel piece portions 15, 16.

The arc portions 55, 58 cause the barrel piece portions 15, 16 to buckle inward. The first arc portion 55 guides the first barrel piece portion 15 toward the second barrel piece portion 16, and causes the first barrel piece portion 15 to buckle toward the second barrel piece portion 16. The second arc portion 58 guides the second barrel piece portion 16 toward the first barrel piece portion 15, and causes the second barrel piece portion 16 to buckle toward the first barrel piece portion 15. The first barrel piece portion 15 gets under the second barrel piece portion 16, on the side of the electrical wire 60, and is wrapped around the electrical wire 60. The first barrel piece portion 15 wrapped around the electrical wire 60 collectively covers the core wire 61 and the cover 62 of the electrical wire 60. The second barrel piece portion 16 is wrapped around an outer side of the first barrel piece portion 15. The electrical wire connecting portion 12 wrapped around the electrical wire 60 is crimped to the core wire 61 and the cover 62 of the electrical wire 60.

FIG. 6 illustrates the terminal-equipped electrical wire 4. With the terminal-equipped electrical wire 4, the electrical wire connecting portion 12 is wrapped around the electrical wire 60 by the terminal crimping device 100. The cover 62 of the electrical wire 60 protrudes from a rear end of the electrical wire connecting portion 12. FIG. 7 illustrates a cross-section taken along VII-VII in FIG. 6. FIG. 8 illustrates a cross-section taken along VIII-VIII in FIG. 7. As illustrated in FIGS. 7 and 8, the first barrel piece portion 15 is positioned on the inside than the second barrel piece portion 16, and is wrapped around the electrical wire 60. The protruding piece 18 is positioned at an apex portion 15*b* of the first barrel piece portion 15 after crimping. The apex portion 15*b* is a part, of the first barrel piece portion 15 after crimping, farthest from the bottom portion 14 in the third direction H. That is, a cross-sectional shape of the first barrel piece portion 15 after crimping is a curved shape protruding on an opposite side from the bottom portion 14. The apex portion 15*b* is a curved apex portion in the third direction H.

The protruding piece 18 extends toward the bottom portion 14 from the apex portion 15*b* of the first barrel piece portion 15. As illustrated in FIG. 8, the protruding piece 18 is separated from a distal end 61*a* of the core wire 61 in the first direction L while facing the distal end 61*a* of the core wire 61. The protruding piece 18 forms, between the protruding piece 18 and the distal end 61*a* of the core wire 61, a filling space 25 which is filled with the water-blocking material 20. The water-blocking material 20 is present between the inner side surface of the electrical wire connecting portion 12 and the core wire 61, and covers the distal end 61*a* of the core wire 61.

The water-blocking material 20 which is compressed in the crimping step is pushed toward an opening 19 at a front end of the electrical wire connecting portion 12 (see an arrow Y3 in FIG. 9, for example). The opening 19 at the front end is an opening, of the electrical wire connecting portion 12, on the side of the terminal connecting portion 11. As described below, the protruding piece 18 blocks at least a part of the opening 19, and restricts the water-blocking material 20 from flowing out.

As illustrated in FIGS. 7 and 8, the protruding piece 18 is bent in a direction intersecting the first direction L, and blocks at least a part of the opening 19. The protruding piece 18 of the present embodiment blocks an upper region of the opening 19. Additionally, "upper" and "lower" indicate a positional relationship where the bottom portion 14 is oriented downward in a vertical direction. Because the protruding piece 18 blocks a part of the opening 19, an opening area of the opening 19 is reduced. Furthermore, an opening width of the opening 19 is reduced. For example, an opening width H1 illustrated in FIGS. 7 and 8 is reduced. The opening width H1 is a width of the gap between the inner side surface of the bottom portion 14 and the distal end 18*b* of the protruding piece 18 in the third direction H.

Because the opening area and the opening width of the opening 19 are reduced, the water-blocking material 20 is restricted from flowing out. The water-blocking material 20 pushed toward the opening 19 comes into contact with the protruding piece 18. The water-blocking material 20 adheres to the protruding piece 18, and movement of the water-blocking material 20 is thereby restricted. Moreover, because the opening width of the opening 19 is reduced, the water-blocking material 20 does not easily pass through the opening 19. The protruding piece 18 of the present embodiment may thus restrict the water-blocking material 20 from flowing out of the electrical wire connecting portion 12.

Furthermore, the protruding piece 18 of the present embodiment intersects a center axis line X1 of the opening 19. In other words, the protruding piece 18 blocks a center portion of the opening 19. It is assumed that the water-blocking material 20 which is pushed by crimping most easily protrudes at the center portion of the opening 19 toward an external space. When the center portion of the opening 19 is blocked by the protruding piece 18, the water-blocking material 20 is effectively prevented from flowing out.

As illustrated in FIG. 8, the protruding piece 18 of the present embodiment is bent in such a way that the protruding piece 18 is closer to the distal end 61*a* of the core wire 61 on the distal end 18*b* side of the protruding piece 18 than on the proximal end side. Accordingly, as described below with reference to FIG. 9, an entire surface of the distal end 61*a* of the core wire 61 is more likely to be covered by the water-blocking material 20. FIG. 9 is a cross-sectional view illustrating movement of the water-blocking material 20 in the crimping step. As indicated by the arrow Y3 in FIG. 9, at the time of crimping, the water-blocking material 20 is pushed toward the opening 19. As indicated by an arrow Y4, the water-blocking material 20 which is pushed moves along the protruding piece 18, and is guided toward the distal end 61*a* of the core wire 61. Accordingly, a front surface of the distal end 61*a* is likely to be covered by the water-blocking material 20. Furthermore, filling of the filling space 25 by the water-blocking material 20 is facilitated, and waterproof performance is increased.

Furthermore, because the protruding piece 18 is tilted with respect to the third direction H, crimping performance is not easily reduced by the protruding piece 18. A case is assumed where, in the crimping step, the protruding piece 18 abuts against the bottom portion 14. In this case, if the protruding piece 18 is parallel to the third direction H, the protruding piece 18 possibly prevents compression of the electrical wire connecting portion 12. On the other hand, the protruding piece 18 which is tilted with respect to the third direction H is not likely to obstruct compression of the electrical wire connecting portion 12 even when abutting against the bottom portion 14.

Furthermore, as described below with reference to FIG. 10, the protruding piece 18 is capable of blocking an air space created in the water-blocking material 20. FIG. 10 is a cross-sectional view illustrating an air space created in the water-blocking material. An air space 26 is created in the water-blocking material 20 illustrated in FIG. 10. For example, the air space 26 is created near the center axis line X1. The air space 26 has a cylindrical shape, and extends in the first direction L. The protruding piece 18 blocks a front end 26*a* of the air space 26. That is, in the case where the air space 26 is created, the protruding piece 18 blocks the front end 26*a* of the air space 26, and closes off the air space 26 from an external space. The protruding piece 18 may thus increase the waterproof performance of the terminal-equipped electrical wire 4.

As described above, the terminal-equipped electrical wire 4 of the present embodiment includes the electrical wire 60, the crimp terminal 1, and the water-blocking material 20. The electrical wire 60 includes the core wire 61, and the cover 62 covering the core wire 61, and a part of the core wire 61 including the distal end 61*a* is exposed from the cover 62. The crimp terminal 1 includes the electrical wire connecting portion 12 which is wrapped around the electrical wire 60 to collectively cover the core wire 61 and the cover 62. The water-blocking material 20 is present between the inner side surface of the electrical wire connecting portion 12 and the core wire 61, and covers the distal end 61*a* of the core wire 61.

The electrical wire connecting portion 12 includes the bottom portion 14, the first barrel piece portion 15, the second barrel piece portion 16, and the protruding piece 18. The first barrel piece portion 15 is a first crimping piece which is joined to one end of the bottom portion 14 in a width direction, and which is wrapped around the electrical wire 60 to collectively cover the core wire 61 and the cover 62. The second barrel piece portion 16 is a second crimping piece which is joined to the other end of the bottom portion 14 in the width direction, and which is wrapped on an outer side of the first barrel piece portion 15.

The protruding piece 18 protrudes from the side surface 15*c* of the first barrel piece portion 15 in an axial direction of the electrical wire 60. The protruding piece 18 is bent from a proximal end portion in such a way that the protruding piece 18 is closer to the distal end 61*a* of the core wire 61 on the distal end 18*b* side than on the proximal end side, and blocks at least a part of the opening 19 of the electrical wire connecting portion 12. By blocking at least a part of the opening 19, the protruding piece 18 restricts the water-blocking material 20 from flowing out, and increases the waterproof performance of the terminal-equipped electrical wire 4. Furthermore, because the protruding piece 18 is tilted in such a way that the protruding piece 18 is closer to the distal end 61*a* of the core wire 61 on the distal end 18*b* side than on the proximal end side, even if the protruding piece 18 abuts against the bottom portion 14, crimping performance of the electrical wire connecting portion 12 is not easily reduced. Accordingly, the terminal-equipped electrical wire 4 of the present embodiment may increase reliability while securing the waterproof performance. Moreover, the protruding piece 18 guides, toward the distal end 61*a*, the water-blocking material 20 which is pushed toward the opening 19, and may thus restrict the water-blocking material 20 from flowing out.

The protruding piece 18 or the present embodiment is separated from the distal end 61*a* of the core wire 61 in the axial direction of the electrical wire 60 while facing the distal end 61*a* of the core wire 61. The protruding piece 18 forms the filling space 25 between the protruding piece 18 and the distal end 61*a* of the core wire 61, and causes the filling space 25 to be filled with the water-blocking material 20. The protruding piece 18 may thus increase the waterproof performance of the terminal-equipped electrical wire 4. Additionally, the protruding piece 18 may be in contact with the distal end 61*a* of the core wire 61. However, even in a case where the protruding piece 18 and the distal end 61*a* are substantially in contact with each other, the water-blocking member 20 is desirably present between the protruding piece 18 and the distal end 61*a*.

The protruding piece 18 of the present embodiment is disposed at the first barrel piece portion 15. In the case where the protruding piece 18 is disposed at the first barrel piece portion 15, the protruding piece 18 is less likely to obstruct wrapping in the crimping step, than in a case where the protruding piece 18 is disposed at the second barrel piece portion 16.

The shape of the first barrel piece portion 15 (see FIG. 7) at the cross section perpendicular to the axial direction of the electrical wire 60 is a curved shape protruding on the opposite side from the bottom portion 14. The protruding piece 18 is joined to the curved apex portion 15*b* of the first barrel piece portion 15. Because the protruding piece 18 protrudes from the apex portion 15*b*, the position of the protruding piece 18 in the second direction W is not easily shifted. An effect that the water-blocking material 20 does not easily flow out may thereby be achieved.

First Modification of Embodiment

Figure 11:
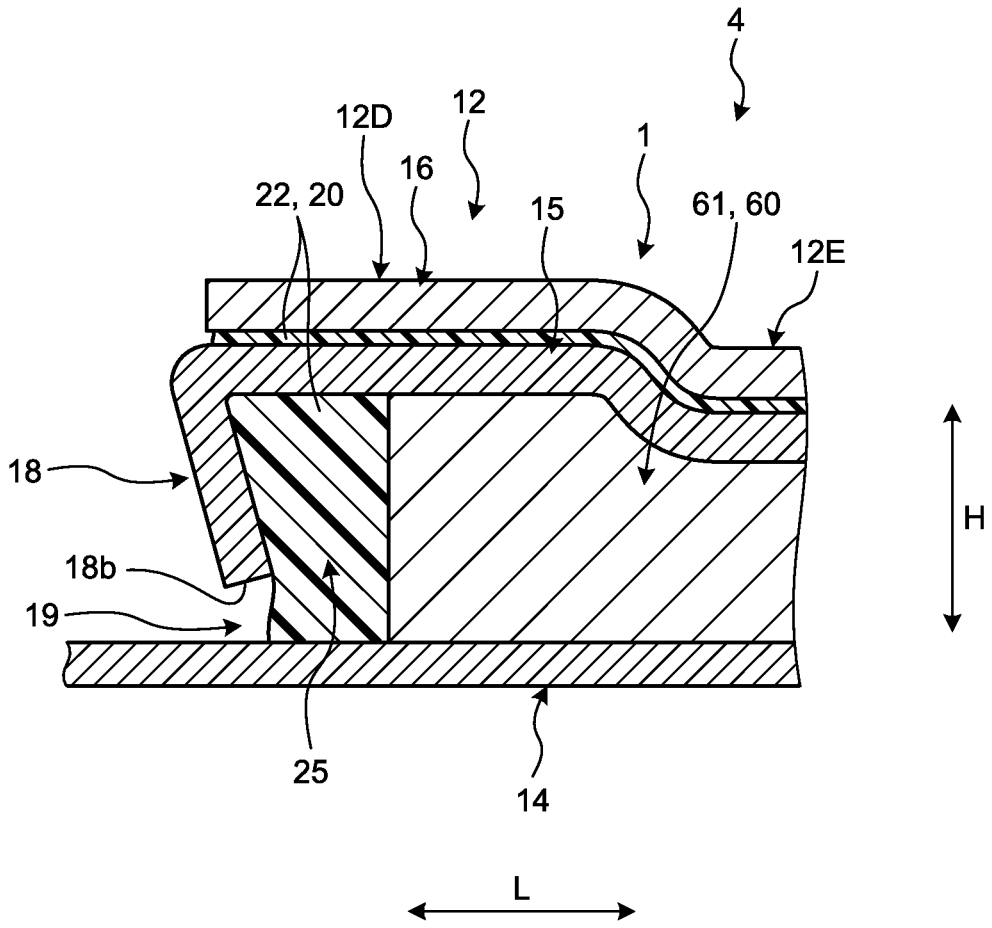
FIG. 11 is a cross-sectional view of a terminal-equipped electrical wire according to a first modification of the embodiment.

A first modification of the embodiment will be described. FIG. 11 is a cross-sectional view of a terminal-equipped electrical wire according to the first modification of the embodiment. A terminal-equipped electrical wire 4 according to the first modification is different from the terminal-equipped electrical wire 4 of the embodiment described above in that the electrical wire connecting portion 12 includes an enlarged diameter portion 12D, for example.

The enlarged diameter portion 12D is positioned at a front end portion of the electrical wire connecting portion 12. A cross-sectional area of the enlarged diameter portion 12D is greater than a cross-sectional area of a part 12E of the electrical wire connecting portion 12, on a rear side of the enlarged diameter portion 12D. Compared with the part 12E on the rear side, the enlarged diameter portion 12D has a greater width in the second direction W and a greater height in the third direction H. For example, the enlarged diameter portion 12D is provided to prevent the electrical wire connecting portion 12 from being extended in the crimping step. A compression rate of the enlarged diameter portion 12D in the crimping step is lower than that of the part 12E on the rear side. Accordingly, an overall compression rate of the electrical wire connecting portion 12 is reduced, and extension of the electrical wire connecting portion 12 is suppressed.

In the case where the enlarged diameter portion 12D is provided, an opening area of the opening 19 tends to be increased. However, because the protruding piece 18 is provided, the filling space 25 is appropriately filled with the water-blocking material 20. Accordingly, even in the case of the terminal-equipped electrical wire 4 with the opening 19 having a large opening area, the protruding piece 18 is capable of securing required waterproof performance. As a result, the crimping step is simplified, and the productivity is increased.

Second Modification of Embodiment

Figure 12:
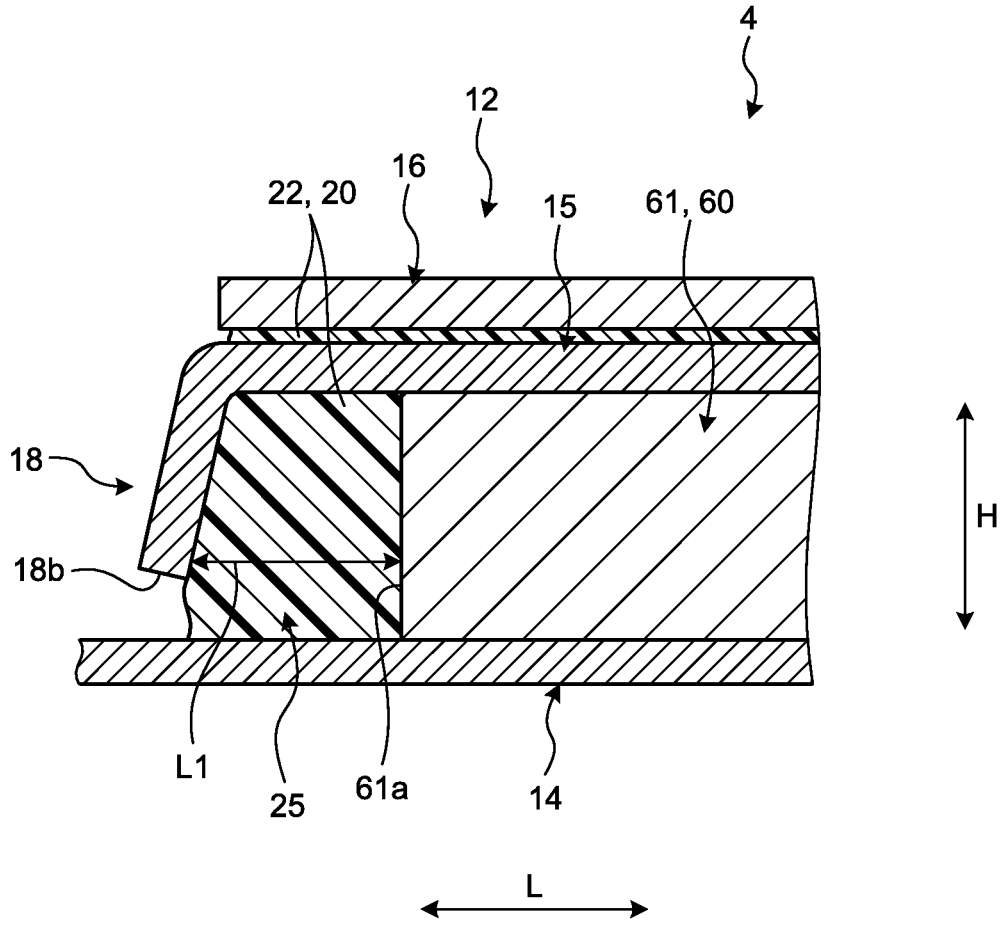
FIG. 12 is a cross-sectional view of a terminal-equipped electrical wire according to a second modification of the embodiment.

A second modification of the embodiment will be described. FIG. 12 is a cross-sectional view of a terminal-equipped electrical wire according to the second modification of the embodiment. A terminal-equipped electrical wire 4 according to the second modification is different from the terminal-equipped electrical wire 4 of the embodiment described above with respect to a tilt direction of the protruding piece 18, for example.

As illustrated in FIG. 12, the protruding piece 18 of the second modification is bent further away from the distal end 61*a* of the core wire 61 on the distal end 18*b* side of the protruding piece 18 than on the proximal end side. In this case, a depth L1 of the filling space 25 may be sufficiently secured. The waterproof performance of the terminal-equipped electrical wire 4 may thereby be increased. Additionally, like the protruding piece 18 of the embodiment described above, the protruding piece 18 of the second modification achieves an effect that the water-blocking material 20 is prevented from flowing out.

Third Modification of Embodiment

A third modification of the embodiment will be described. In the embodiment described above, the crimping step is performed after bending of the protruding piece 18. Alternatively, the protruding piece 18 may be bent in the crimping step. For example, a protruding portion for bending the protruding piece 18 may be provided at the swage portion 50*a* of the crimper 50.

The position of the protruding piece 18 is not limited to the position illustrated in the embodiment. For example, the protruding piece 18 of the embodiment described above is disposed at an end portion of the first barrel piece portion 15 in the second direction W. The position of the protruding piece 18 at the first barrel piece portion 15 may be a position at other than the end portion in the second direction W. Furthermore, the protruding piece 18 may be provided at the second barrel piece portion 16, instead of the first barrel piece portion 15.

The shape of the protruding piece 18 is not limited to the illustrated shape. For example, the shape of the protruding piece 18 may be a tapered shape, a width of which is more reduced on the distal end 18*b* side of the protruding piece 18 than on the proximal end side. The shape of the protruding piece 18 may be a shape, a width of which is more increased on the distal end 18*b* side of the protruding piece 18 than on the proximal end side. The shape of the protruding piece 18 may be a shape other than a rectangle. For example, a shape of the distal end 18*b* of the protruding piece 18 may be a curved shape such as an arc shape. A cross-sectional shape of the protruding piece 18 (see FIG. 8) does not have to be straight. For example, the cross-sectional shape of the protruding piece 18 may be a shape which is curved in the first direction L. The cross-sectional shape of the protruding piece 18 may be a shape, a thickness of which is reduced toward the distal end 18*b*.

A region of the opening 19 which is blocked by the protruding piece 18 does not have to be the region illustrated in the embodiment described above. For example, the protruding piece 18 may block the opening 19 in such a way that the opening width H1 between the distal end 18*b* and the bottom portion 14 becomes substantially zero.

Contents disclosed in the embodiment and the modifications described above can be realized by being appropriately combined.

A terminal-equipped electrical wire according to the embodiment includes an electrical wire including a core wire and a cover covering the core wire, where a distal end portion of the core wire is exposed from the cover, a terminal including an electrical wire connecting portion wrapped around the electrical wire to collectively cover the core wire and the cover, and a water-blocking material present between an inner side surface of the electrical wire connecting portion and the core wire, and covering a distal end of the core wire.

The electrical wire connecting portion includes a bottom portion, a first crimping piece joined to one end of the bottom portion in a width direction, and wrapped around the electrical wire to collectively cover the core wire and the cover, a second crimping piece joined to another end of the bottom portion in the width direction, and wrapped around an outer side of the first crimping piece, and a plate-shaped protruding piece protruding from a side surface of the first crimping piece or the second crimping piece in an axial direction of the electrical wire. The protruding piece is bent from a proximal end portion in such a way that the protruding piece is closer to the distal end of the core wire on a distal end side of the protruding piece than on a proximal end side, and blocks at least a part of an opening of the electrical wire connecting portion. With the terminal-equipped electrical wire according to the present invention, because the protruding piece blocks at least a part of the opening of the electrical wire connecting portion, the water-blocking material is prevented from flowing out. The protruding piece is tilted in such a way that the protruding piece is closer to the distal end of the core wire on the distal end side than on the proximal end side, and thus, the protruding piece is less likely to reduce crimping performance. Accordingly, the terminal-equipped electrical wire according to the present invention achieves an effect that reliability may be increased while securing waterproof performance.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal-equipped electrical wire comprising:

an electrical wire including a core wire and a cover covering the core wire, a distal end portion of the core wire being exposed from the cover;

a terminal including an electrical wire connecting portion wrapped around the electrical wire to collectively cover the core wire and the cover; and a water-blocking material disposed between an inner side surface of the electrical wire connecting portion and the core wire to cover a distal end of the core wire, wherein the electrical wire connecting portion includes a bottom portion, a first crimping piece joined to one end of the bottom portion in a width direction and wrapped around the electrical wire to collectively cover the core wire and the cover, a second crimping piece joined to another end of the bottom portion in the width direction and wrapped around an outer side of the first crimping piece, and a plate-shaped protruding piece protruding from a side surface of the first crimping piece or the second crimping piece in an axial direction of the electrical wire, and the protruding piece is bent from a proximal end portion such that the protruding piece is closer to the distal end of the core wire toward a distal end side from a proximal end side of the protruding piece, and blocks at least a part of an opening of the electrical wire connecting portion.

* * * * *